US010843861B2

(12) United States Patent
Wang

(10) Patent No.: US 10,843,861 B2
(45) Date of Patent: Nov. 24, 2020

(54) DRINK CUP HAVING AUTOMATIC RETRACTABLE STRAW

(71) Applicant: YUAN MIN ALUMINUM CO., LTD., Tainan (TW)

(72) Inventor: Kuan-Hsiang Wang, Tainan (TW)

(73) Assignee: Yuan Min Aluminum Co., Ltd., Tainan (TW)

( * ) Notice: Subject to any disclaimer, the term of this patent is extended or adjusted under 35 U.S.C. 154(b) by 23 days.

(21) Appl. No.: 16/244,316

(22) Filed: Jan. 10, 2019

(65) Prior Publication Data

US 2019/0218011 A1 Jul. 18, 2019

(30) Foreign Application Priority Data

Jan. 17, 2018 (TW) ..... 107200822 A

(51) Int. Cl.

| | |
|---|---|
| ***A47G 19/22*** | (2006.01) |
| ***B65D 77/28*** | (2006.01) |
| ***B65D 47/06*** | (2006.01) |
| ***B65D 47/08*** | (2006.01) |

(52) U.S. Cl.

CPC ..... *B65D 77/283* (2013.01); *A47G 19/2266* (2013.01); *B65D 47/061* (2013.01); *B65D 47/089* (2013.01); *B65D 77/28* (2013.01); *B65D 2547/066* (2013.01)

(58) Field of Classification Search

CPC .... B65D 77/28; B65D 77/283; B65D 47/061; B65D 47/089; B65D 2547/066; B65D 81/3841; A47G 19/2266; A47G 19/2222; A47G 21/18

USPC ..... 215/229, 388; 239/33; 220/705, 707, 220/708, 709, 710

See application file for complete search history.

(56) References Cited

U.S. PATENT DOCUMENTS

| | | | | |
|---|---|---|---|---|
| 6,196,413 | B1 * | 3/2001 | Tung | B65D 47/0885 215/229 |
| 2005/0029271 | A1 * | 2/2005 | McDonough | A47G 19/2266 220/709 |
| 2006/0006134 | A1 * | 1/2006 | Luo | B65D 77/283 215/388 |
| 2010/0170902 | A1 * | 7/2010 | Britto | B65D 47/066 220/367.1 |
| 2014/0166654 | A1 * | 6/2014 | Lane | A47G 19/2272 220/262 |

(Continued)

*Primary Examiner* — Fenn C Mathew
*Assistant Examiner* — Elizabeth J Volz
(74) *Attorney, Agent, or Firm* — Rosenberg, Klein & Lee

(57) ABSTRACT

A drink cup having an automatic retractable straw is disclosed herein. It comprises a main body having an outer cup, an inner cup having a guide inclined surface at a bottom thereof, and a vacuum insulation layer between the outer cup and the inner cup; a lid covered on the main body and having an opening at one side thereof for corresponding to an upper end of the guide inclined surface, a containing groove adjacent to the opening on a top surface thereof, and a flip cover pivotally disposed on the containing groove and having a convex part corresponding to the opening; and a straw accommodated in the inner cup and having a connecting member formed with a first perforation at one end thereof for connecting to an upper end of the straw and a second perforation corresponding to the bonding part of the lid at the other end thereof.

3 Claims, 5 Drawing Sheets

(56) References Cited

U.S. PATENT DOCUMENTS

2015/0114982 A1* 4/2015 Rapp ..... B65D 77/283
220/708

* cited by examiner

DRINK CUP HAVING AUTOMATIC RETRACTABLE STRAW

BACKGROUND OF THE INVENTION

1. Field of the Invention

The present invention relates to a drink cup which has an automatic retractable straw to be retracted into a main body when not in use and simultaneously driven to protrude outward for use when a flip cover is opened so as to allow a user to conveniently consume a beverage and increase practicality of the drink cup in its overall application.

2. Description of Related Art

Nowadays, consumers usually buy and consume various drinks everywhere from the stores selling all kinds of drinks. In order to achieve environmental protection, consumers began to use a variety of reusable vacuum flasks to accommodate beverages, so that the beverages can be kept at a certain temperature to prevent the beverage from rapidly cooling in cold winter days or heating up in hot summer days.

Generally, the bore diameters of openings or capacity of various cups or vacuum flasks carried by consumers are difficult to match with the utensils used in the store, which is inconvenient for the store employees to fill a drink. Furthermore, the cups or vacuum flasks are not equipped with a straw, so the user needs to insert the straw into the cup or vacuum flask when consuming the contained beverage. However, the length of the inserted straw usually does not match the height of the cup or vacuum flask, and the straw cannot be placed in the cup or vacuum flask when the user does not drink the beverage, so the conventional cup and vacuum flask are quite inconvenient to use.

SUMMARY OF THE INVENTION

In view of the above-mentioned problems, the object of the present invention is to provide a drink cup which has an automatic retractable straw to be retracted into a main body when not in use and simultaneously driven to protrude outward for use when a flip cover is opened so as to allow a user to conveniently consume a beverage and increase practicality of the drink cup in its overall application.

DETAILED DESCRIPTION OF THE PREFERRED EMBODIMENT

Hereinafter, an exemplary embodiment of the present invention will be described in detail with reference to the accompanying drawings.

Figure 1:
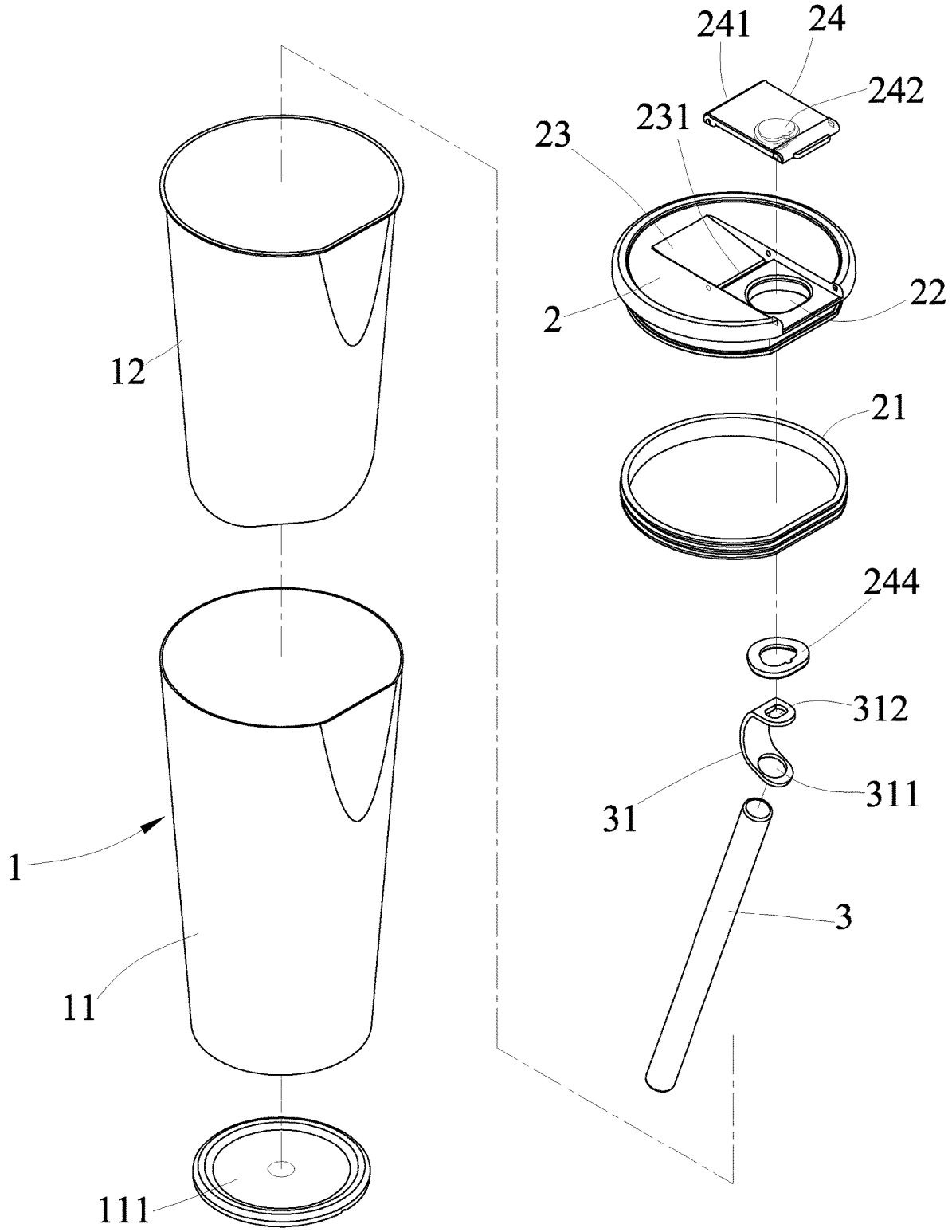
FIG. 1 is an explosion diagram showing a drink cup having an automatic retractable straw according to the present invention.
Figure 2:
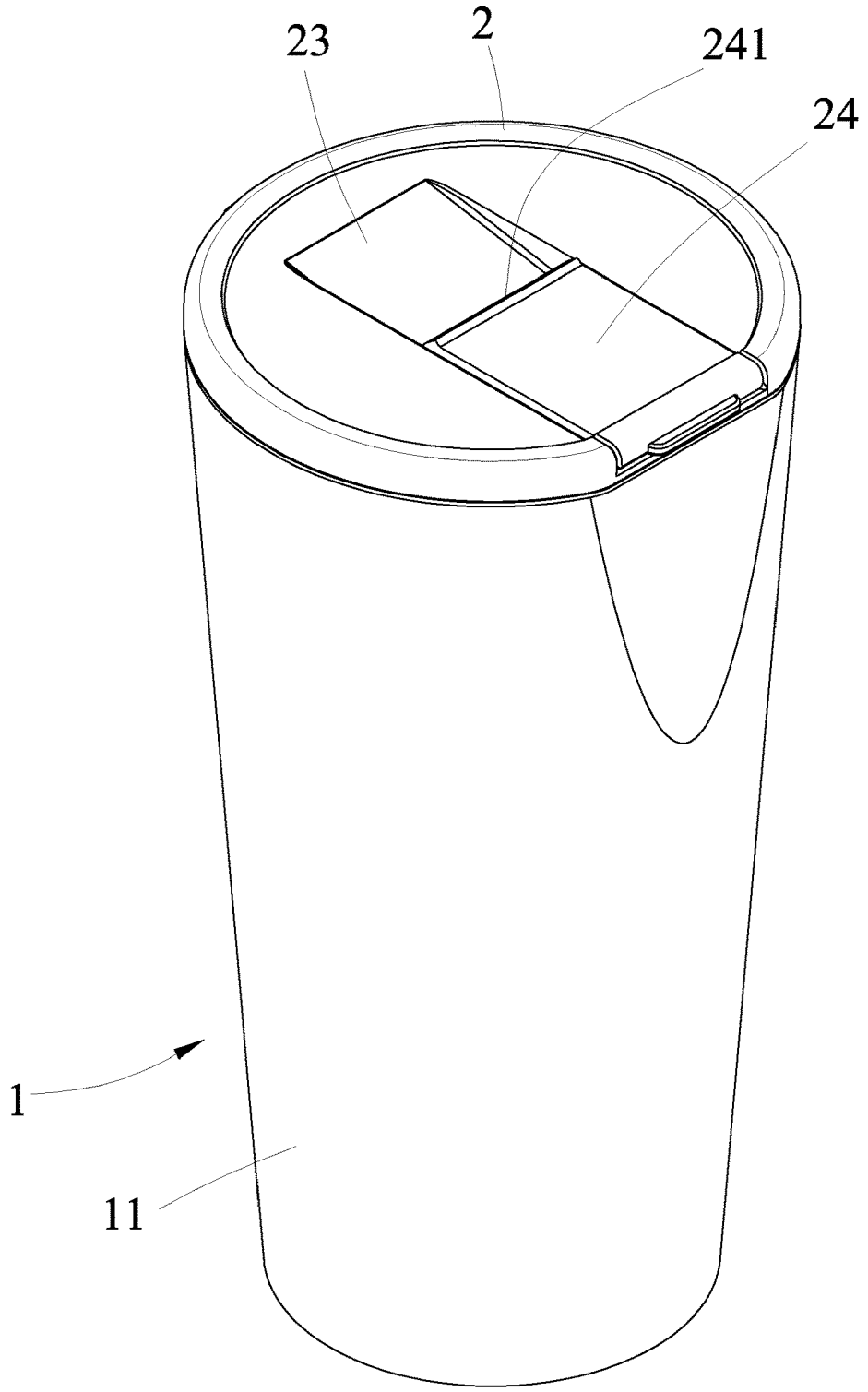
FIG. 2 is a stereogram showing a drink cup having an automatic retractable straw in assembly according to the present invention.
Figure 3:
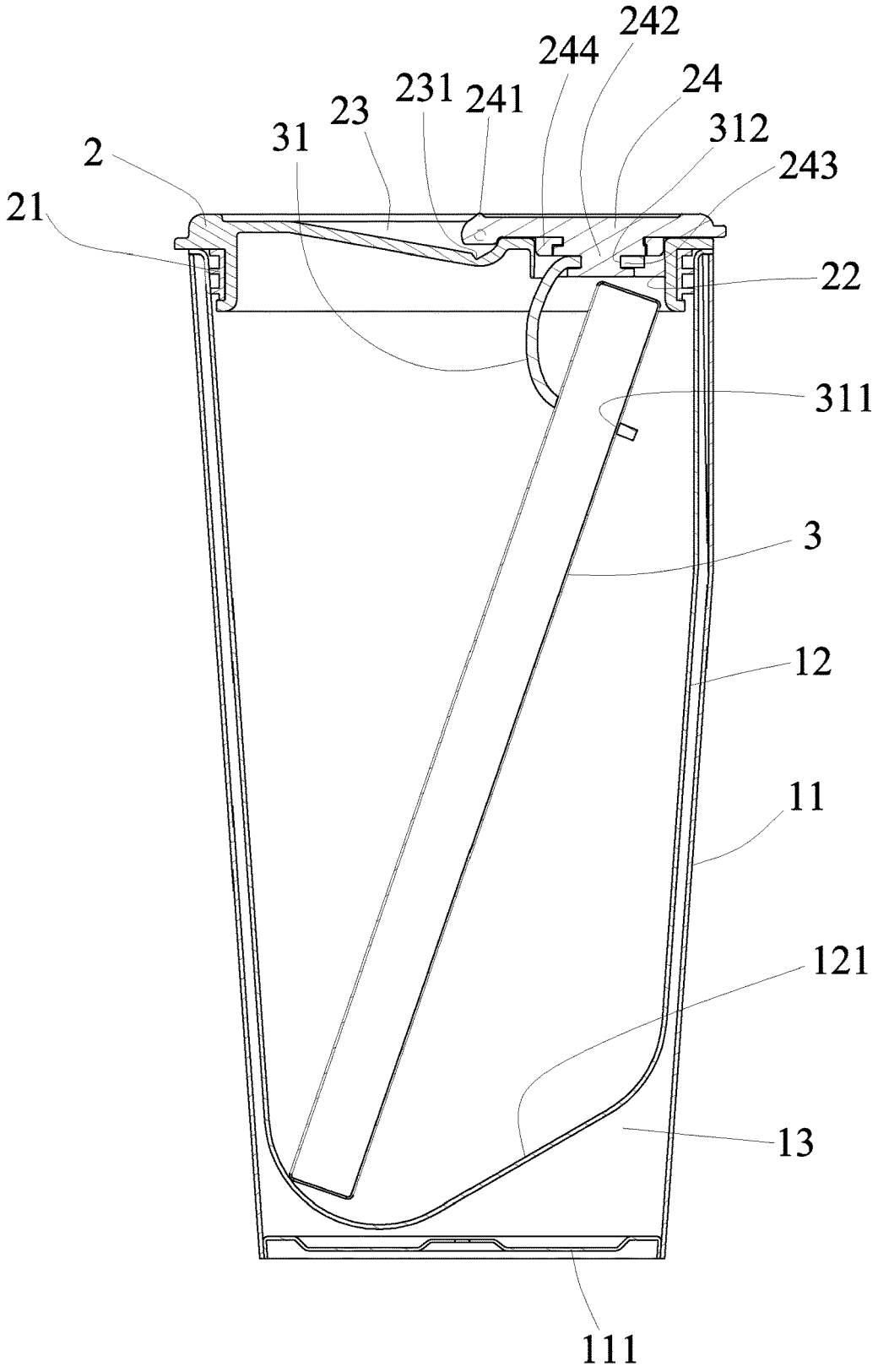
FIG. 3 is a cross-sectional view showing a drink cup having an automatic retractable straw in assembly according to the present invention.

As showed in FIG. 1, FIG. 2 and FIG. 3, a drink cup having an automatic retractable straw according to the present invention is disclosed herein. It mainly comprises a main body (1), a lid (2) and a straw (3).

The main body (1) is provided with an outer cup (11) having a base (111) at its bottom, an inner cup (12) connected to the outer cup (11), and a vacuum insulation layer (13) between the outer cup (11) and the inner cup (12) for blocking the heat conduction from the inner cup (12). Furthermore, the inner cup (12) has a guide inclined surface (121) at its bottom.

The lid (2) is covered on a top of the main body (1) and comprises a leakproof ring (21) disposed between the main body (1) and the lid (2), an opening (22) at one side thereof for corresponding to an upper end of the guide inclined surface (121) of the inner cup (12), a containing groove (23) adjacent to the opening (22) on a top surface thereof, and a flip cover (24) pivotally disposed on the containing groove (23). The containing groove (23) is provided with a concave slot (231). The flip cover (24) is provided with a protrusion part (241) corresponding to the concave slot (231), a convex part (242) corresponding to the opening (22), a bonding part (243) at a bottom of the convex part (242), and a sealing ring (244) disposed at an outer edge of the convex part (242).

The straw (3) is completely accommodated in the inner cup (12) of the main body (1) and provided with a connecting member (31). The connecting member (31) is made of a silicone material and comprises a first perforation (311) at its one end for connecting to an upper end of the straw (3) and a second perforation (312) corresponding to the bonding part (243) of the lid (2) at the other end thereof. The connecting member (31) connects the bonding part (243) of the flip cover (24) by the second perforation (312) for positioning.

Accordingly, when the flip cover (24) of the lid (2) is in a close state, the flip cover (24) drives the straw (3) to be downwardly retracted so that the bottom end of the straw (3) contacts a lower end of the guide inclined surface (121). In such a case, the whole straw (3) is accommodated in the inner cup (12) of the main body (1), and the flip cover (24) is covered on the opening (22) of the lid (2). At the same time, the convex part (242) of the flip cover (24) is plugged on the opening (22), and the opening (22) is also sealed by the sealing ring (244) at the outer edge of the convex part (242), so the beverage in the main body (1) does not flow out from the opening (22).

Figure 4:
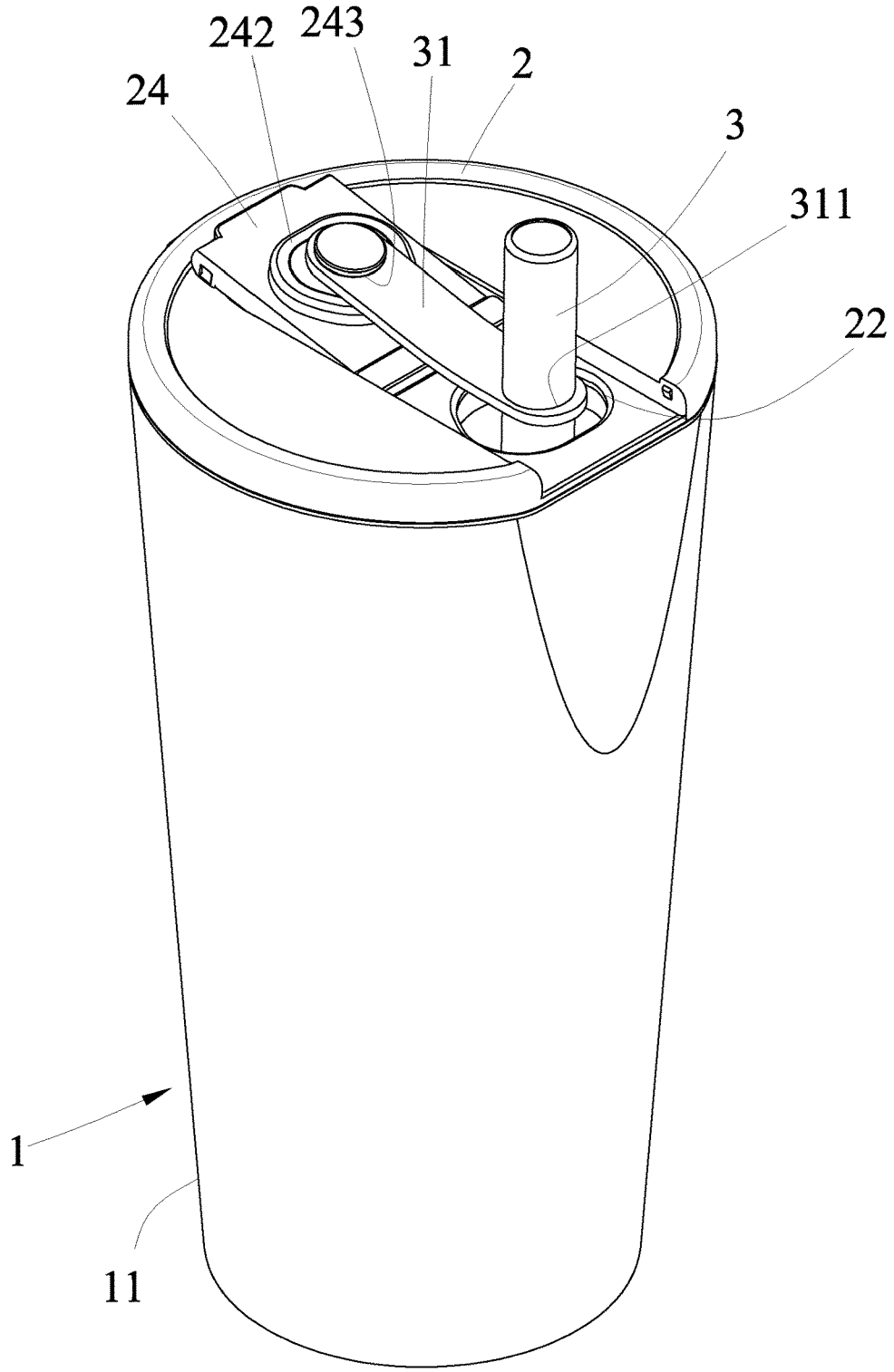
FIG. 4 is a stereogram showing a flip cover in an open state according to the present invention.
Figure 5:
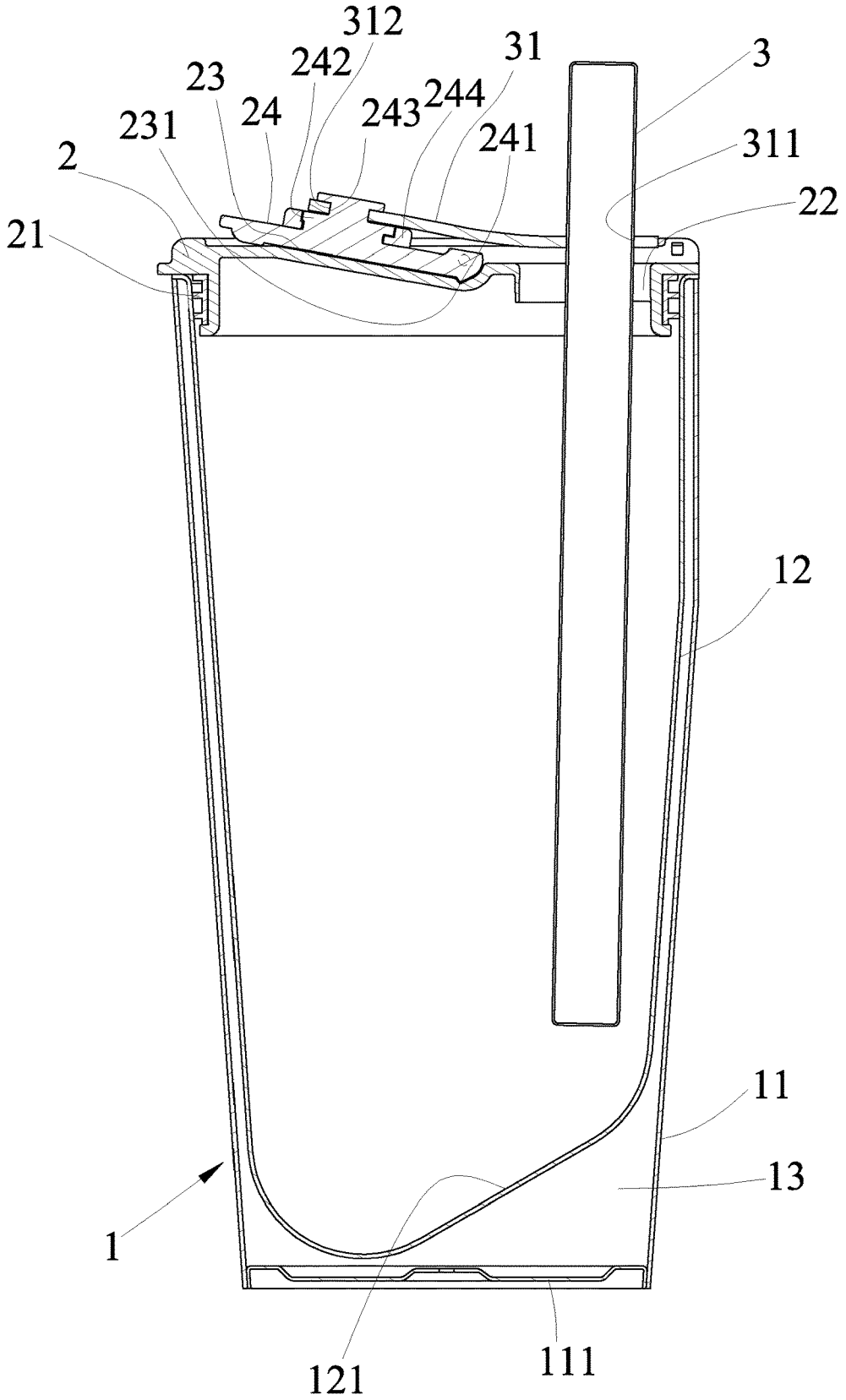
FIG. 5 is a cross-sectional view showing the flip cover in the open state according to the present invention.

Referring to FIG. 4 and FIG. 5, a stereogram and a cross-sectional view showing a flip cover in an open state according to the present invention are disclosed. After the flip cover (24) of the lid (2) is opened, the convex part (242) of the flip cover (24) is no longer plugged on the opening (22) and away from the opening (22). Since the second perforation (312) of the connecting member (31) correspondingly connects the bonding part (243) at the bottom of the convex part (242) of the flip cover (24) for positioning, the connecting member (31) is pulled simultaneously by opening of the flip cover (24) and further drives the straw (3) to move upwardly along the guide inclined surface (121). After the flip cover (24) is completely opened and accommodated in the containing groove (23) and the protrusion part (241) of the flip cover (24) is engaged with the concave slot (231) of the containing groove (23), the straw (3) is driven by the connecting member (31) to move to the upper end of the guide inclined surface (121) of the inner cup (12). In such a case, the straw (3) is protruded out of the opening (22), which is convenient for a user to suck a beverage contained in the inner cup (12) of the main body (1). Furthermore, the inner cup (12) is provided with the guide inclined surface (121), when the beverage in the inner cup (12) is drunk to a height lower than the upper end of the guide inclined surface (121), the main body (1) can be inclined to let the beverage in the inner cup (12) flow along the guide inclined surface (121) to its upper end, Accordingly, the user can conveniently and continuously suck the beverage by the straw (3).

Compared with the technique available now, the present invention has the following advantages:

1. The present invention having the vacuum insulation layer formed between the outer cup and the inner cup can be directly used for accommodating a beverage to block the heat conduction from the inner cup, so it can keep the beverage from rapidly cooling or heating up.

2. The present invention has the automatic retractable straw which is can be retracted into the main body when not in use and simultaneously driven to protrude outward for use when a flip cover is opened, so it is convenient for the user to consume the beverage contained in the main body and has the increased practicality in its overall application.

What is claimed is:

1. A drink cup having an automatic retractable straw, comprising:

a main body having an outer cup, an inner cup connected to the outer cup and a vacuum insulation layer between the outer cup and the inner cup for blocking the heat conduction from the inner cup, wherein the inner cup has a guide inclined surface at a bottom thereof;

a lid covered on a top of the main body and having an opening at one side thereof for corresponding to an upper end of the guide inclined surface of the inner cup, a containing groove adjacent to the opening on a top surface thereof and being provided with a concave slot, and a flip cover pivotally disposed on the containing groove and being provided with a protrusion part for correspondingly engaging with the concave slot, wherein the flip cover has a convex part corresponding to the opening and a bonding part at a bottom of the convex part; and a straw accommodated in the inner cup of the main body and having a connecting member, wherein the connecting member is provided with a first perforation at one end thereof for connecting to an upper end of the straw and a second perforation corresponding to the bonding part of the lid at the other end thereof for connecting the bonding part of the flip cover for positioning.

2. The drink cup having an automatic retractable straw as claimed in claim 1, wherein an outer edge of the convex part is provided with a sealing ring.

3. A drink cup having an automatic retractable straw, comprising:

a main body having an outer cup, an inner cup connected to the outer cup and a vacuum insulation layer between the outer cup and the inner cup for blocking the heat conduction from the inner cup, wherein the inner cup has a guide inclined surface at a bottom thereof;

a lid covered on a top of the main body and having an opening at one side thereof for corresponding to an upper end of the guide inclined surface of the inner cup, a containing groove adjacent to the opening on a top surface thereof, and a flip cover pivotally disposed on the containing groove, wherein the flip cover has a convex part corresponding to the opening and a bonding part at a bottom of the convex part, the convex part having an outer edge and a sealing ring disposed thereon; and a straw accommodated in the inner cup of the main body and having a connecting member, wherein the connecting member is provided with a first perforation at one end thereof for connecting to an upper end of the straw and a second perforation corresponding to the bonding part of the lid at the other end thereof for connecting the bonding part of the flip cover for positioning.

* * * * *